US010683782B2

(12) United States Patent
Geyer

(10) Patent No.: US 10,683,782 B2
(45) Date of Patent: Jun. 16, 2020

(54) TWO STROKE, OPPOSED PISTON ENGINE WITH COMPRESSION RELEASE BRAKE ARRANGEMENT AND METHOD

(71) Applicant: VOLVO TRUCK CORPORATION, Göteborg (SE)

(72) Inventor: Stephen Geyer, Greencastle, PA (US)

(73) Assignee: Volvo Truck Corporation, Göteborg (SE)

( * ) Notice: Subject to any disclaimer, the term of this patent is extended or adjusted under 35 U.S.C. 154(b) by 98 days.

(21) Appl. No.: 15/512,561

(22) PCT Filed: Sep. 29, 2014

(86) PCT No.: PCT/US2014/058107
§ 371 (c)(1),
(2) Date: Mar. 19, 2017

(87) PCT Pub. No.: WO2016/053256
PCT Pub. Date: Apr. 7, 2016

(65) Prior Publication Data
US 2017/0218799 A1 Aug. 3, 2017

(51) Int. Cl.
*F01L 13/06* (2006.01)
*F02B 75/28* (2006.01)
(Continued)

(52) U.S. Cl.
CPC ..... *F01L 13/065* (2013.01); *F01B 7/14* (2013.01); *F01L 1/047* (2013.01); *F01L 1/12* (2013.01);
(Continued)

(58) Field of Classification Search
CPC ..... F01L 13/065; F01L 13/08; F01L 13/06; F01L 1/12; F01L 13/0021; F01L 1/18;
(Continued)

(56) References Cited

U.S. PATENT DOCUMENTS 3,547,087 A 12/1970 Siegler
6,000,374 A 12/1999 Cosma et al.
(Continued)

FOREIGN PATENT DOCUMENTS

CN 1291137 C 12/2006
CN 203271850 U 11/2013
(Continued)

OTHER PUBLICATIONS

International Search Report (dated Jan. 2, 2015) for corresponding International App. PCT/US2014/058107.
(Continued)

*Primary Examiner* — Joseph J Dallo
*Assistant Examiner* — Scott A Reinbold
(74) *Attorney, Agent, or Firm* — WRB-IP LLP

(57) ABSTRACT

A two-stroke, opposed-piston engine includes a cylinder with an inlet piston controlled inlet port and an exhaust piston controlled exhaust port, the cylinder defining a combustion chamber with the inlet piston and the exhaust piston, a charge air channel in flow communication with the inlet port, a conduit extending directly from the combustion chamber to the charge air channel, and a valve arranged to selectively open and close flow communication through the conduit.

20 Claims, 6 Drawing Sheets

(51) Int. Cl.

| | |
|---|---|
| ***F02B 25/08*** | (2006.01) |
| ***F01L 13/08*** | (2006.01) |
| ***F01L 1/12*** | (2006.01) |
| ***F02D 13/02*** | (2006.01) |
| ***F02D 13/04*** | (2006.01) |
| ***F01B 7/14*** | (2006.01) |
| ***F01L 1/047*** | (2006.01) |
| ***F01L 1/18*** | (2006.01) |
| ***F01L 13/00*** | (2006.01) |
| ***F02B 75/02*** | (2006.01) |
| ***F01L 3/00*** | (2006.01) |

(52) U.S. Cl.
CPC ..... *F01L 1/18* (2013.01); *F01L 13/0021* (2013.01); *F01L 13/06* (2013.01); *F01L 13/08* (2013.01); *F02B 25/08* (2013.01); *F02B 75/02* (2013.01); *F02B 75/28* (2013.01); *F02D 13/028* (2013.01); *F02D 13/0276* (2013.01); *F02D 13/04* (2013.01); *F01L 2003/25* (2013.01); *F02B 2075/025* (2013.01)

(58) Field of Classification Search
CPC ..... F01L 1/047; F01L 2003/25; F02B 75/02; F02B 75/28; F02B 25/08; F02B 2075/025; F02D 13/0276; F02D 13/028; F02D 13/04; F01B 7/14; F16H 61/21; F16D 2500/3062
USPC ..... 123/231
See application file for complete search history.

(56) References Cited

U.S. PATENT DOCUMENTS

| | | | | |
|---|---|---|---|---|
| 6,209,495 | B1 | 4/2001 | Warren | |
| 6,279,520 | B1 | 8/2001 | Lowi, Jr. | |
| 6,668,809 | B2 | 12/2003 | Lowi, Jr. et al. | |
| 6,779,494 | B1 | 8/2004 | Aswani | |
| 6,959,672 | B1 | 11/2005 | Peng et al. | |
| 8,079,339 | B2 | 12/2011 | Smith | |
| 8,151,749 | B2 | 4/2012 | Smith et al. | |
| 8,397,685 | B2 | 3/2013 | Lowi | |
| 8,485,161 | B2 | 7/2013 | Lemke | |
| 8,549,854 | B2 | 10/2013 | Dion et al. | |
| 2002/0117133 | A1* | 8/2002 | Ma | F01L 1/02 123/90.17 |
| 2009/0173299 | A1 | 7/2009 | Warren | |
| 2012/0125298 | A1* | 5/2012 | Lemke | F01B 7/14 123/51 B |
| 2012/0210985 | A1* | 8/2012 | Fuqua | F01L 1/38 123/51 B |
| 2012/0272645 | A1 | 11/2012 | McKaig et al. | |
| 2013/0220249 | A1 | 8/2013 | Lowe | |

FOREIGN PATENT DOCUMENTS

| | | | |
|---|---|---|---|
| DE | 482085 | | 9/1929 |
| DE | 202013002671 | U1 | 6/2013 |
| EP | 2677141 | A1 | 12/2013 |
| WO | 2009089060 | A1 | 7/2009 |
| WO | 2015192859 | A1 | 12/2015 |

OTHER PUBLICATIONS

International Preliminary Report on Patentability (dated Nov. 30, 2016) for corresponding International App. PCT/US2014/058107.
European Official Action (dated Mar. 14, 2018) for corresponding European App. EP 14 903 309.4.
Chinese Official Action (dated Dec. 20, 2018) for corresponding Chinese App. 201480082308.3.

* cited by examiner

TWO STROKE, OPPOSED PISTON ENGINE WITH COMPRESSION RELEASE BRAKE ARRANGEMENT AND METHOD

BACKGROUND AND SUMMARY

The present invention relates generally to two stroke, opposed piston engines and, more particularly, to compression release brake arrangements and methods for such engines.

In conventional diesel engines that have a single piston per cylinder, a compression release braking function or engine retarder brake can be achieved by opening the exhaust valves at the top of the compression stroke, resulting in adiabatic expansion of the compressed air, so the large amount of energy stored in that compressed air is not returned to the crankshaft, but is released into the atmosphere, http://en.wikipedia.org/wiki/Engine braking Normally during the compression stroke, energy is used as the upward-traveling piston compresses an in the cylinder; the compressed air then acts as a compressed spring and pushes the piston back down. However, with the engine retarder brake in operation, the compressed air is suddenly released just before the piston begins its downward travel. Having lost the energy stored within the compressed air, there is no 'spring back' from it so the engine must expend yet more energy pulling the piston back down again.

In typical opposed piston engine designs, it is not possible to open an exhaust valve at the top of the compression stroke because an exhaust port in the cylinder wall is closed by the exhaust piston. Accordingly, it is desirable to provide an apparatus and method for performing a compression release braking function in a two stroke, opposed piston engine.

In accordance with an aspect of the present invention, a two-stroke, opposed-piston engine comprises a cylinder including an inlet port and an exhaust port, an inlet piston movable in the cylinder between an inlet piston top dead center (IPTDC) position and an inlet piston bottom dead center (IPDBC) position, an exhaust piston movable in the cylinder between an exhaust piston top dead center (OPTDC) position and an exhaust piston bottom dead center (OPBDC) position, a charge air channel in fluid communication with the inlet port, a combustion chamber defined by the cylinder, the inlet piston, and the exhaust piston, the inlet piston permitting flow communication between the inlet port and the combustion chamber when the inlet piston is in the IPBDC position and blocking flow communication between the inlet port and the combustion chamber when the inlet piston is in the IPTDC position, the exhaust piston permitting flow communication between the exhaust port and the combustion chamber when the exhaust piston is in the OPBDC position and blocking flow communication between the exhaust port and the combustion chamber when the exhaust piston is in the OPTDC position, a conduit extending directly from the combustion chamber to the charge air channel, and a valve arranged to selectively open and close flow communication through the conduit.

In accordance with another aspect of the present invention, a two-stroke, opposed-piston engine comprises a cylinder with an inlet piston controlled inlet port and an exhaust piston controlled exhaust port, the cylinder defining a combustion chamber with the inlet piston and the exhaust piston, a charge air channel in flow communication with the inlet port, a conduit extending directly from the combustion chamber to the charge air channel, and a valve arranged to selectively open and close flow communication through the conduit.

In accordance with yet another aspect of the present invention, a method of operating a two-stroke, opposed-piston engine is provided, the engine comprising a cylinder with an inlet piston controlled inlet port and an exhaust piston controlled exhaust port, the cylinder defining a combustion chamber with the inlet piston and the exhaust piston, and a charge air channel in flow communication with the inlet port. The method comprises selectively opening and closing flow communication through a conduit extending directly from the combustion chamber to the charge air channel.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
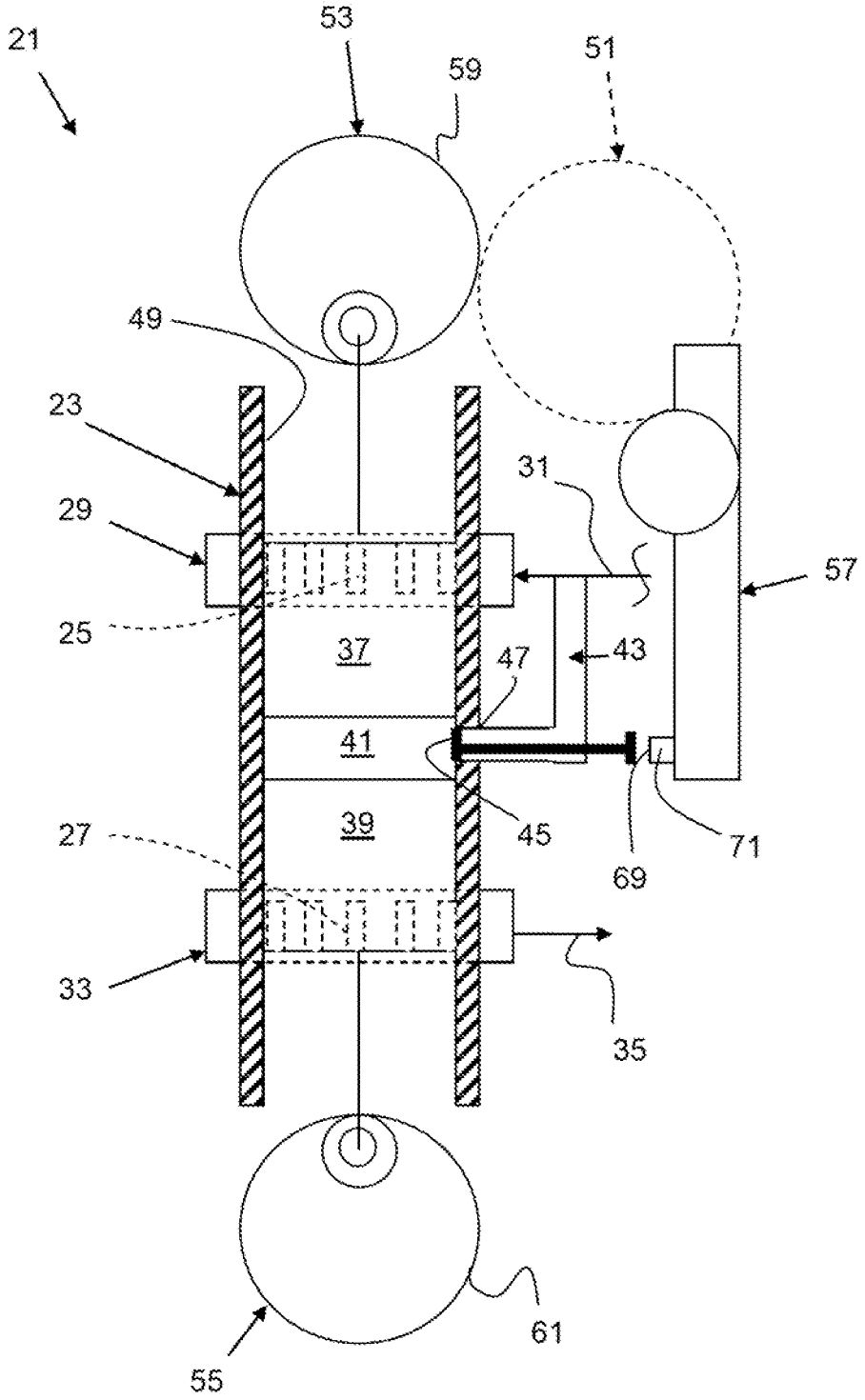
FIGS. 1-4 are schematic, partially cross-sectional views of an engine according to an aspect of the present invention.

A two-stroke, opposed-piston engine 21 according to an aspect of the present invention is seen in FIGS. 1-4 and comprises a cylinder 23 including an inlet port 25 and an exhaust port 27. The inlet port 25 and the exhaust port 27 are typically in the form of a plurality of openings in the cylinder wall. The openings are typically elongated in a direction of a longitudinal axis of the cylinder 23.

The inlet port 25 typically leads to an inlet gallery 29 in flow communication with a charge an channel 31. A compressor of as turbocharger (not shown) and a supercharger or other form of blower (not shown), and one or more charge air coolers (not shown) are typically disposed upstream of the inlet gallery 29 to provide pressurized air to facilitate scavenging of the cylinder 23.

The exhaust port 27 typically leads to an exhaust gallery 33 in flow communication with an exhaust channel 35. A turbine of a turbocharger (not shown), an exhaust gas recirculation line (not shown) that connects to the charge air channel 31 are typically disposed downstrean of the exhaust gallery 33, along with other exhaust aftertreatment devices (not shown) such as a diesel particulate filter, and a selective catalyst reduction catalyst.

Figure 2:
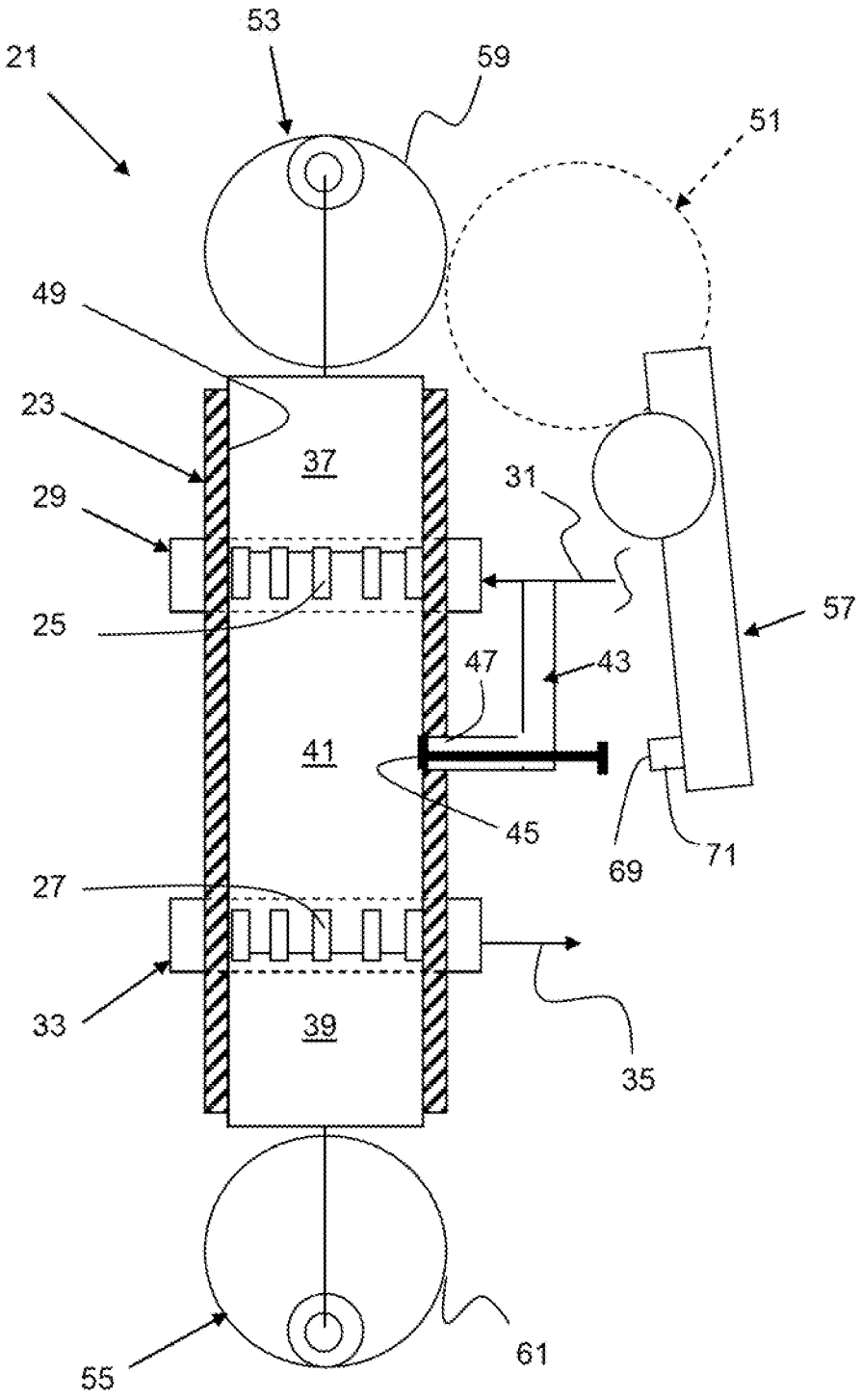
Figure 3:
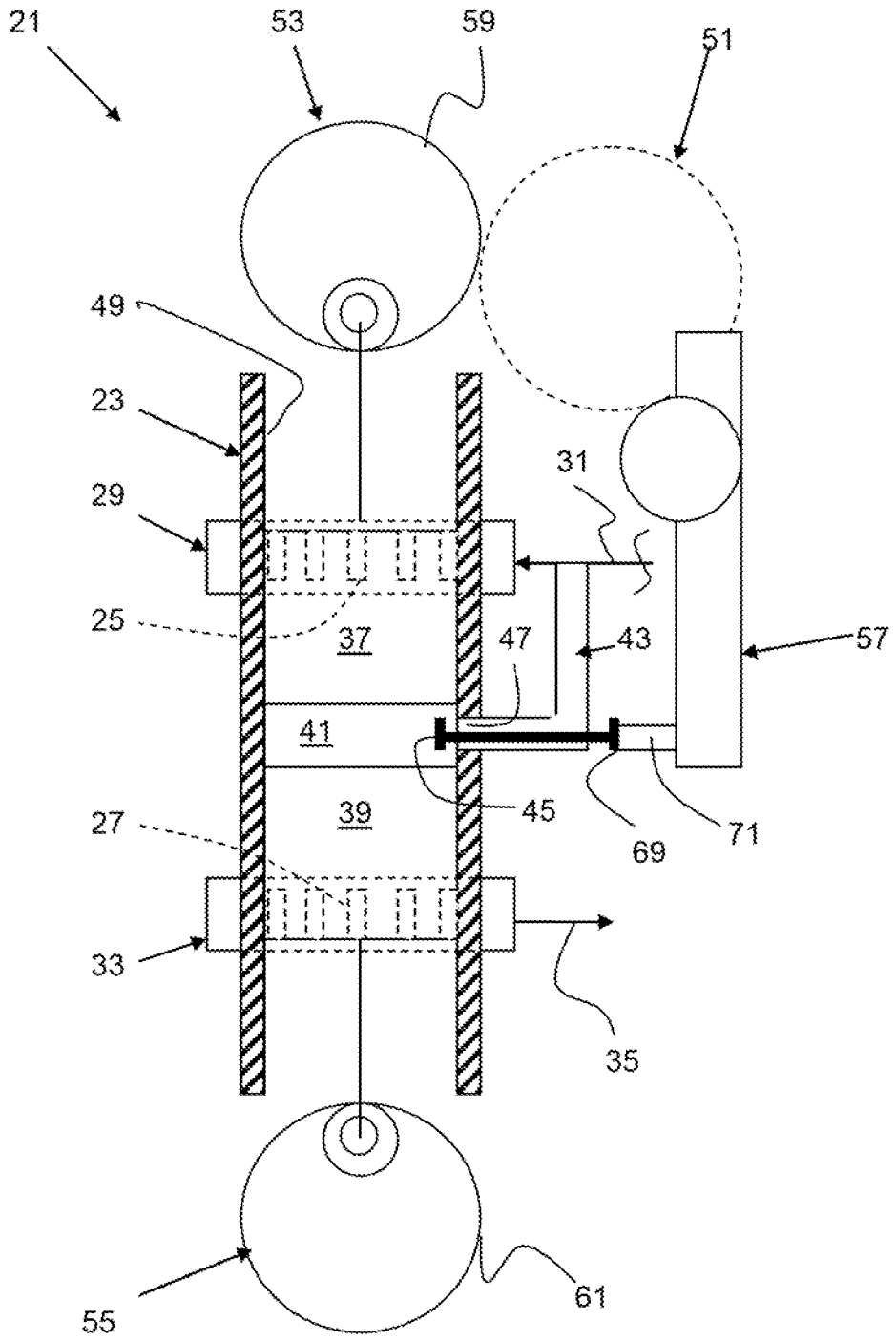
Figure 4:
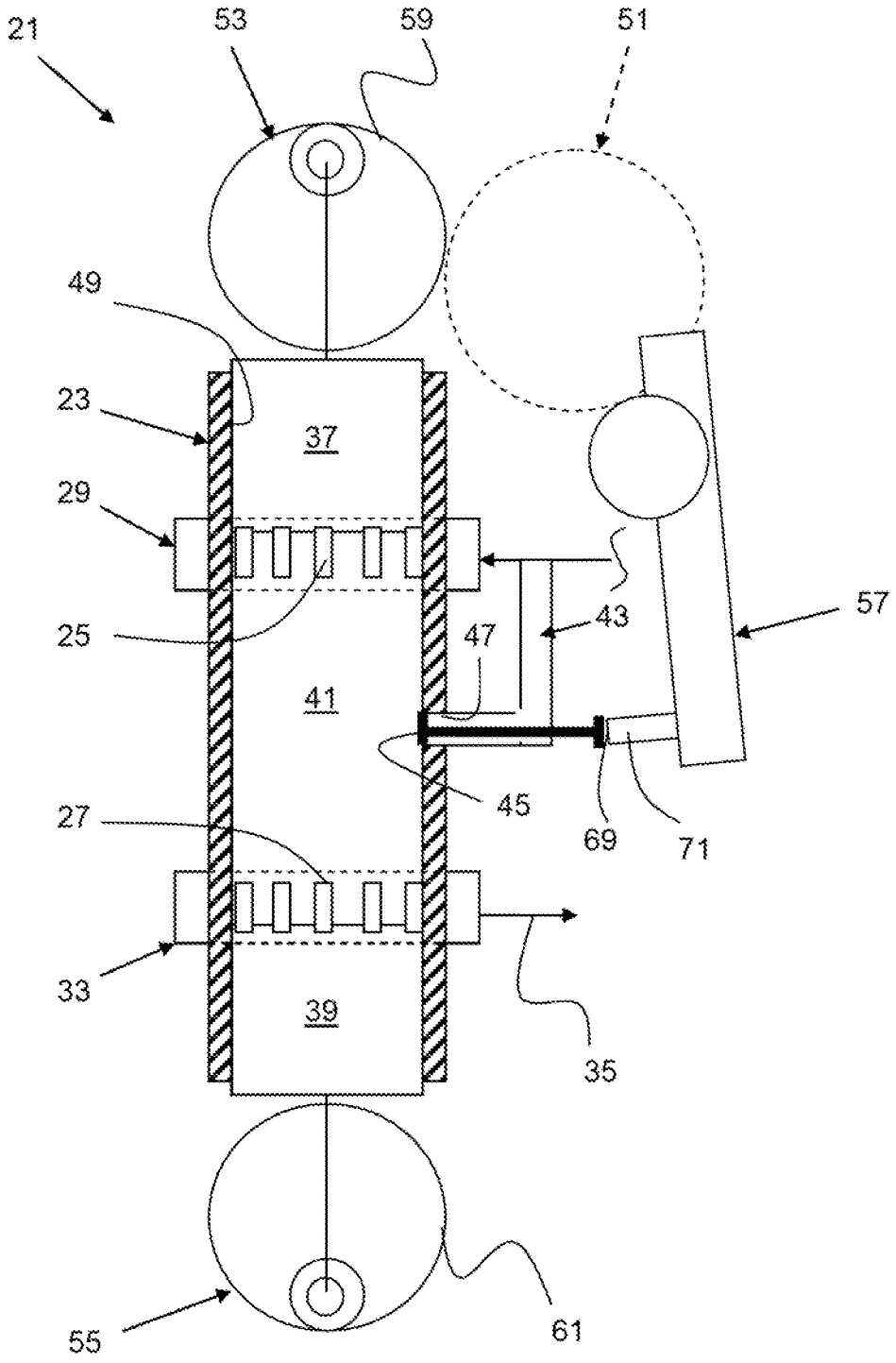

An inlet piston 37 is movable in the cylinder 23 between an inlet piston top dead center (IPTDC) position (FIGS. 1 and 3) and an inlet piston bottom (lead center (IPDBC) position (FIGS. 2 and 4), and an exhaust piston 39 is movable in the cylinder between an exhaust piston top dead center (OPTDC) position (FIGS. 1 and 3) and an exhaust piston bottom dead center (OPBDC) position (FIGS. 2 and 4). The inlet piston 37 permits flow communication between the inlet port 25 and a combustion chamber 41 defined by the cylinder 23, the inlet piston 37 when the inlet piston is in the IPBDC position and blocks flow communication between the inlet port and the combustion chamber when the inlet piston is in the IPTDC position. Similarly, the exhaust piston 39 permits flow communication between the exhaust port 27 and the combustion chamber 41 when the exhaust piston is in the OPBDC position and blocking flow communication between the exhaust port and the combustion chamber when the exhaust piston is in the OFTDC position.

It will be appreciated that, typically, the inlet piston 37 and the exhaust piston will completely block the inlet port 25 and the exhaust port 27, respectively, at some point well before and after the IPDBC and OPDBC positions. While FIGS. 1-4 show the inlet piston 37 and the exhaust piston 39 being in their respective top dead center positions and bottom dead center positions at the same time, the movement of the pistons will often be timed so that the exhaust port 27 opens before the inlet port 25 opens and closes before the inlet port closes. In this way, pressurized combustion gases in the combustion chamber 41, and the exhaust piston 39 will start exiting the cylinder through the exhaust port 27 before charge air starts entering the cylinder through the inlet port 25 and further forces the combustion gases out of the cylinder, facilitating uniflow scavenging.

A conduit 43 extends directly from the combustion chamber 41 to the charge air channel 31. The conduit 43 extends directly from the combustion chamber 41 to the charge air channel 31 in the sense that there is no intermediate structure between the combustion chamber and the charge air channel, e.g., the conduit does not first open to the exhaust channel 35 or some kind of accumulator.

A valve 45 is arranged to selectively open and close flow communication through the conduit 43. By selectively opening and closing it is intended to refer to opening and closing under control of an operator or a suitable controller (e.g., an ECU) programmed to open and close flow communication under particular circumstances, as opposed to opening and closing that occurs randomly or at all times. A compression release brake function can be provided by selectively opening flow communication through the conduit 43 via the valve 45.

The valve 45 is ordinarily a poppet valve arranged to open and close port 47 in the wall 49 of the cylinder 23 that leads to the conduit 43, however, the valve may be another form of valve that closes the conduit itself. A spring (not shown) will ordinarily be provided to urge a poppet or other form of valve 45 to a closed position as seen in FIGS. 1, 2, and 4. Ordinarily, but not necessarily, the valve 45 is arranged to selectively open and close flow communication through the conduit 43 only when the inlet piston 37 and the exhaust piston 39 are both in positions in which flow communication between the combustion chamber 41 and both the inlet port 25 and the exhaust port 27 is blocked by the inlet piston and the exhaust piston, respectively.

The valve 43 can be arranged to selectively open and close flow communication through the conduit 45 via a hear and camshaft arrange lent 51 driven by one or both of an inlet crankshaft 53 driven by the inlet piston 37 and an exhaust crankshaft 55 driven b the exhaust piston 39, where the gear and camshaft arrangement in turn drives a rocker arm 57 that pivots to open and close the valve. The valve 43 can, alternatively, be arranged to selectively open and close flow communication through the conduit 45 via hydraulic, pneumatic, or electronic drives (not shown) that can be controlled by an operator or a controller such as an ECU.

Figure 5:
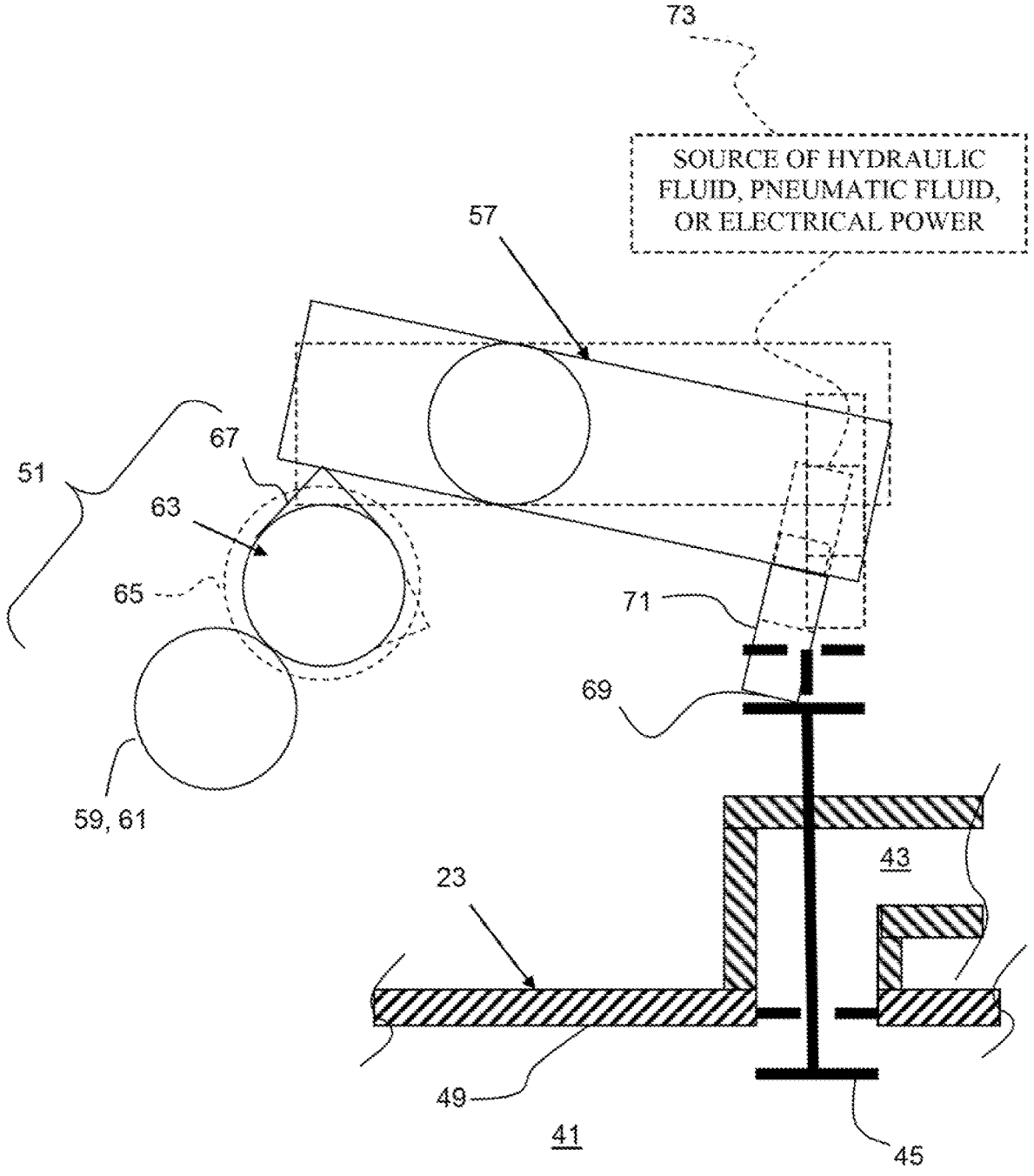
FIGS. 5 and 6 are schematic, partially cross-sectional views of a portion of an engine according to an aspect of the present invention showing a gear and camshaft arrangement for moving a rocker arm for moving a valve to open and close a conduit.

As seen in FIG. 5, at least one of the inlet crankshaft 53 can include an inlet crank gear 59 and the exhaust crankshaft 55 can include an exhaust crank gear 61. A camshaft 63 can include a cam drive gear 65 driven by the at least one of the inlet crank gear 59 and the exhaust crank gear 61, and a cam 67 on the camshaft arranged to drive the rocker arm 57 to move the valve 45 to permit selective opening and closing of flow communication through the conduit 43 by the valve. Idler gears (not shown) will typically be disposed between gears mounted on the inlet crankshaft 53 and/or the exhaust crankshaft 55 such as the inlet crank gear 59 and/or the exhaust crank gear 61.

The rocker arm 57 can comprise a surface 69 that contacts the valve 45 to move it between an extended position and a retracted position (shown in phantom in FIG. 5) as the cam 67 rotates. The rocker arm surface 69 that contacts the valve 45 can be a surface of a rocker arm piston 71 that is movable outwardly from a first position (shown in phantom in FIG. 5) to a second position. Rocker arms with movable pistons for opening valves in engines suitable or adaptable for use in connection with the present invention are disclosed in, e.g., U.S. Pat. No. 8,151,749 and U.S. App. Pub. US2013/0220249, which are both incorporated by reference.

Figure 6:
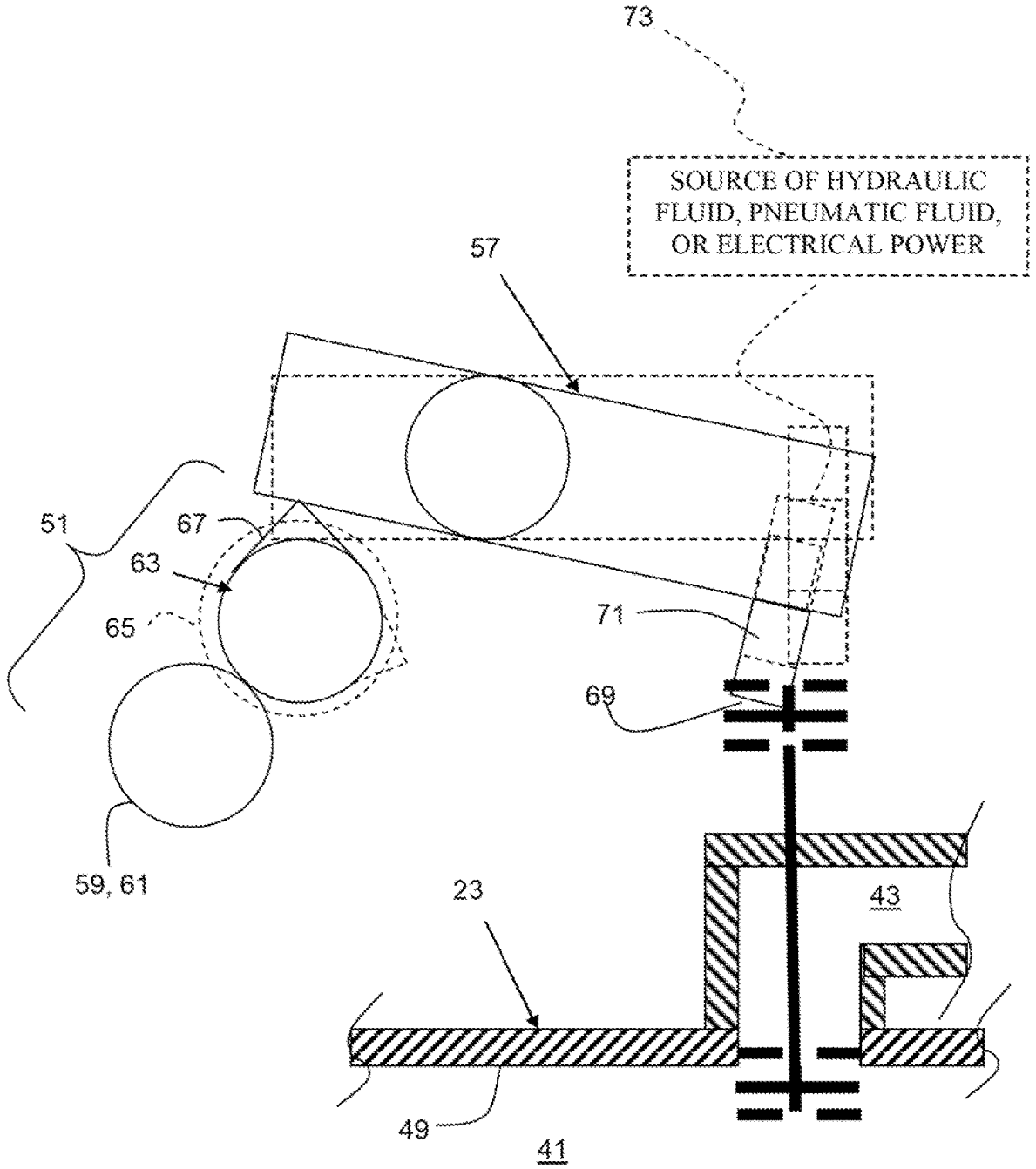

A valve 45 arranged with a gear and camshaft arrangement 51 such as shown in FIG. 5 permits flow communication through the conduit 43 only when the rocker arm piston 71 is at least partially moved away from the first position toward the second position. The rocker arm piston 71 may be any one of hydraulically driven, pneumatically driven, or electrically driven (e.g., via a solenoid) between the first and second positions. The rocker arm 57 can be connected to a source 73 (shown in phantom) of hydraulic or pneumatic fluid or electrical power. As seen in FIG. 6, the rocker arm piston 71 may be moved to positions between the first and second positions so that the degree of opening of the conduit 43 by the valve 45 can be increased or decreased as desired to vary the compression release brake function achieved.

A method aspect of the invention involves operating a two-stroke opposed-piston engine 21 that comprises a cylinder 23 with an inlet piston 37 controlled inlet port 25 and an exhaust piston 39 controlled exhaust port 27. The cylinder 23 defines a combustion chamber 41 with the inlet piston 37 and the exhaust piston 39. A charge air channel 31 is in flow communication with the inlet port 25. The method comprises selectively opening (FIG. 3) and closing (FIGS. 1, 2, and 4) flow communication through a conduit 43 extending directly from the combustion chamber 41 to the charge air channel 31.

Ordinarily, flow communication through the conduit 43 will be selectively opened and closed only when the inlet piston 37 and the exhaust piston 39 are both in positions in which flow communication between the combustion chamber 41 and both the inlet port 25 and the exhaust port 27 is blocked.

The engine 21 can comprise air inlet crankshaft 55 driven by the inlet piston 37 and an exhaust crankshaft 57 driven by the exhaust piston 39, and at least one of the inlet crankshaft includes an inlet crank gear 59 and the exhaust crankshaft includes an exhaust crank gear 51. A camshaft 63 including a cam drive gear 65 driven by the at least one of the inlet crank gear 59 and the exhaust crank gear 61, and a cam 67 on the camshaft arranged to drive a rocker arm 57 to move a valve 45 to permit the selective opening and closing of flow communication through the conduit 43. The rocker arm 57 can comprise a surface 69 that contacts the valve 45 to move it between an extended position (FIG. 3) and a retracted position (FIGS. 1, 2, and 4) as the cam rotates. The rocker arm surface 69 that contacts the valve 45 can be a surface of a rocker arm piston 71 that is movable outwardly from a first position (FIGS. 1 and 2) to a second position (FIGS. 3 and 4).

The valve 45 ordinarily permits flow communication through the conduit 43 only when the rocker arm piston 71 is at least partially moved away from the first position toward the second position. The method comprises selectively moving the rocker arm piston between the first and second position, e.g., to perform a compression release braking function in response to an operator or controller generated command.

The valve 45 is movable between a fully closed position (FIGS. 1, 2, and 4) in which flow communication through the conduit 4 is completely blocked and a fully open position (FIG. 3) in which flow communication through the conduit is unobstructed by the valve, and to one or more partially open positions (FIG. 6) in which flow communication through the conduit is partially obstructed by the valve. The method can further comprise holding the rocker arm piston 71 in an intermediate position (FIG. 6) between the first position and the second position so that the valve 45 is in one of one or more partially open positions. The rocker arm piston 71 can further be moved between the intermediate position (FIG. 6) and the second position in which the valve 45 is positioned so that the conduit 43 is fully open (FIG. 5, solid lines) or the first position in which the valve is positioned so that the conduit is fully closed.

By providing a conduit 43 that leads directly from the combustion chamber 41 to the charge air channel 31, instead of, for example, through the exhaust channel 35, any actuators used to open and close flow communication through the conduit can be kept in a cooler environment. Additionally, noise from the compression release brake operation is muted because the compression release is not directly into the exhaust system. Further, heat dissipation from the brake operation is handled during, the scavenge event of the two stroke engine.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A two-stroke, opposed-piston engine, comprising:

a cylinder including an inlet port and an exhaust port;

an inlet piston movable in the cylinder between an inlet piston top dead center (IPTDC) position and an inlet piston bottom dead center (IPDBC) position;

an exhaust piston movable in the cylinder between an exhaust piston top dead center (OPTDC) position and an exhaust piston bottom dead center (OPBDC) position;

a charge air channel in fluid communication with the inlet port;

a combustion chamber defined by the cylinder, the inlet piston, and the exhaust piston;

the inlet piston permitting flow communication between the inlet port and the combustion chamber when the inlet piston is in the IPBDC position and blocking flow communication between the inlet port and the combustion chamber when the inlet piston is in the IPTDC position;

the exhaust piston permitting flow communication between the exhaust port and the combustion chamber when the exhaust piston is in the OPBDC position and blocking flow communication between the exhaust port and the combustion chamber when the exhaust piston is in the OPTDC position;

a conduit extending directly from the combustion chamber to the charge air channel;

an exhaust channel in flow communication with the exhaust port and only adapted to be in flow communication with the conduit via the cylinder; and a valve arranged to selectively open and close flow communication through the conduit, wherein opening of the valve provides engine braking and returns heated, compressed air to the charge air channel, the engine being configured so that heat of the returned heated, compressed air is dissipated during a scavenge event of the engine.

2. The engine as set forth in claim 1, wherein the valve is arranged to selectively open and close flow communication through the conduit only when the inlet piston and the exhaust piston are both in positions in which flow communication between the combustion Chamber and both the inlet port and the exhaust port is blocked.

3. The engine as set forth in claim 2, comprising an inlet crankshaft driven by the inlet piston and an exhaust crankshaft driven by the exhaust piston, at least one of the inlet crankshaft including an inlet crank gear and the exhaust crankshaft including an exhaust crank gear, a camshaft including a cam drive gear driven by the at least one of the inlet crank gear and the exhaust crank gear, and a cam on the camshaft arranged to drive a rocker arm to move the valve to permit selective opening and closing of flow communication through the conduit by the valve.

4. The engine as set forth in claim 3, wherein the rocker arm comprises a surface that contacts the valve to move it between an extended position and a retracted position as the cam rotates.

5. The engine as set forth in claim 4, wherein the rocker arm surface that contacts the valve is a surface of a rocker arm piston that is movable outwardly relative to the rocker arm from a first position to a second position, the valve permitting flow communication through the conduit only when the rocker arm piston is at least partially moved away from the first position toward the second position.

6. The engine as set forth in claim 5, wherein the rocker arm piston is one of hydraulically driven, pneumatically driven, or electrically driven between the first and second positions.

7. The engine as set forth in claim 3, wherein the valve is a poppet valve.

8. A two-stroke, opposed-piston engine, comprising:

a cylinder with an inlet piston controlled inlet port and an exhaust piston controlled exhaust port, the cylinder defining a combustion chamber with the inlet piston and the exhaust piston;

a charge air channel in flow communication with the inlet port;

a conduit extending directly from the combustion chamber to the charge air channel;

an exhaust channel in flow communication with the exhaust port and only adapted to be in flow communication with the conduit via the cylinder; and a valve arranged to selectively open and close flow communication through the conduit, wherein opening of the valve provides engine braking and returns heated, compressed air to the charge air channel, the engine being configured so that heat of the returned heated, compressed air is dissipated during a scavenge event of the engine.

9. The engine as set forth in claim 8, wherein the valve is arranged to selectively open and close flow communication through the conduit only when the inlet piston and the exhaust piston are both in positions in which flow communication between the combustion chamber and both the inlet port and the exhaust port is blocked.

10. The engine as set forth in claim 9, comprising an inlet crankshaft driven by the inlet piston and an exhaust crankshaft driven by the exhaust piston, at least one of the inlet crankshaft including an inlet crank gear and the exhaust crankshaft including an exhaust crank gear, a camshaft including a cam drive gear driven by the at least one of the inlet crank gear and the exhaust crank gear, and a cam on the camshaft arranged to drive a rocker arm to move the valve to permit selective opening and closing of flow communication through the conduit by the valve.

11. The engine as set forth in claim 10, wherein the rocker arm comprises a surface that contacts the valve to move it between an extended position and a retracted position as the cam rotates.

12. The engine as set forth in claim 11, wherein the rocker arm surface that contacts the valve is a surface of a rocker arm piston that is movable outwardly relative to the rocker arm from a first position to a second position, the valve permitting flow communication through the conduit only when the rocker arm piston is at least partially moved away from the first position toward the second position.

13. The engine as set forth in claim 12, wherein the rocker arm piston is one of hydraulically driven, pneumatically driven, or electrically driven between the first and second positions.

14. The engine as set forth in claim 10, wherein the valve is a poppet valve.

15. A method of operating a two-stroke, opposed-piston engine, the engine comprising a cylinder with an inlet piston controlled inlet port and an exhaust piston controlled exhaust port, the cylinder defining a combustion chamber with the inlet piston and the exhaust piston, an exhaust channel in flow communication with the exhaust port, and a charge air channel in flow communication with the inlet port, the method comprising:

providing engine braking by selectively opening and closing flow communication through a conduit extending directly from the combustion chamber to the charge air channel by moving a valve between an open and a closed position so that heated, compressed air is returned to the charge air channel;

blocking flow communication between the exhaust channel and the conduit except via the cylinder; and dissipating heat of the returned heated, compressed air during a scavenge event of the engine.

16. The method as set forth in claim 15, comprising, selectively opening and closing flow communication through the conduit only when the inlet piston and the exhaust piston are both in positions in which flow communication between the combustion chamber and both the inlet port and the exhaust port is blocked.

17. The method as set forth in claim 16, wherein the engine comprises an inlet crankshaft driven by the inlet piston and an exhaust crankshaft driven by the exhaust piston, at least one of the inlet crankshaft including an inlet crank gear and the exhaust crankshaft including an exhaust crank gear, a camshaft including a cam drive gear driven by the at least one of the inlet crank gear and the exhaust crank gear, and a cam on the camshaft arranged to drive a rocker arm to move a valve to permit the selective opening and closing of flow communication through the conduit.

18. The method as set forth in claim 17, wherein the rocker arm comprises a surface that contacts the valve to move it between an extended position and a retracted position as the cam rotates, the rocker arm surface that contacts the valve being a surface of a rocker arm piston that is movable outwardly relative to the rocker arm from a first position to a second position, the valve permitting flow communication through the conduit only when the rocker arm piston is at least partially moved away from the first position toward the second position, the method comprising selectively moving the rocker arm piston between the first and second position.

19. The method as set forth in claim 18, wherein the valve is movable between a fully closed position in which flow communication through the conduit is completely blocked and a fully open position in which flow communication through the conduit is unobstructed by the valve, and to one or more partially open positions in which flow communication through the conduit is partially obstructed by the valve, the method comprising holding the rocker arm piston in an intermediate position relative to the main body of the rocker arm between the first position and the second position so that the valve is in one of the one or more partially open positions.

20. The method as set forth in claim 19, comprising moving the rocker arm piston relative to the main body of the rocker arm between the intermediate position and the fully open position.

* * * * *